US006319154B1

(12) United States Patent
Yoshida et al.

(10) Patent No.: US 6,319,154 B1
(45) Date of Patent: Nov. 20, 2001

(54) SOLID GOLF BALL HAVING DEFINED HARDNESS PROFILE

(75) Inventors: Kazunari Yoshida; Keiji Moriyama, both of Akashi (JP)

(73) Assignee: Sumitomo Rubber Industries Limited (JP)

( * ) Notice: Subject to any disclaimer, the term of this patent is extended or adjusted under 35 U.S.C. 154(b) by 0 days.

(21) Appl. No.: 09/434,464

(22) Filed: Nov. 5, 1999

(30) Foreign Application Priority Data

Nov. 9, 1998 (JP) ..... 10-318000
Sep. 9, 1999 (JP) ..... 11-256158

(51) Int. Cl.[7] ..... A63B 37/06
(52) U.S. Cl. ..... 473/378; 473/377
(58) Field of Search ..... 475/377, 378, 475/351

(56) References Cited

U.S. PATENT DOCUMENTS 5,490,673 * 2/1996 Hiraoka ..... 473/377
5,803,834 * 9/1998 Yamagishi et al. ..... 473/377
5,994,470 * 11/1999 Tanaka et al. ..... 525/183

* cited by examiner

*Primary Examiner*—Mark S. Graham
*Assistant Examiner*—Raeann Gorden

(57) ABSTRACT

The present invention provides a solid golf ball which has an improved flying distance, controllability and shot feeling. The solid golf ball has a core and a cover. The core has a hardness of 55 to 75 at a center thereof and a hardness on a surface thereof that is greater than the hardness at the center by 10 or more. The cover has a hardness satisfying the following expressions (1) and (2):

$$(\text{hardness of the cover})-(\text{hardness at the center of the core}) \leqq 17 \quad (1),$$

$$(\text{hardness of the cover})-(\text{hardness on the surface of the core}) \leqq 5 \quad (2).$$

The hardness being defined in terms of JIS-C scale hardness meter.

7 Claims, 1 Drawing Sheet

SOLID GOLF BALL HAVING DEFINED HARDNESS PROFILE

This application is based on patent applications Nos. 10-318000 and 11-256158filed in Japan,the contents of which are hereby incorporated by references.

FIELD OF THE INVENTION

The present invention relates to a solid golf ball having a core and a cover, more particularly, to a solid golf ball which has an improved flying distance, controllability and shot feeling.

BACKGROUND OF THE INVENTION

Hitherto, there have been generally used a thread-wound golf ball and a solid golf ball. A thread-wound golf ball is made by winding a rubber thread around a liquid center or solid center, and then covering the wound center with a balata (i.e., trans-polyisoprene) or ionomer-based resin. A solid golf ball, such as a two- and three-piece golf ball, has a rubber core and a resin cover made of a thermoplastic resin such as ionomer resin. Comparing with a thread-wound golf ball, a solid golf ball can attain a longer flying distance due to a higher initial speed of the ball by a shot of a golf club. In addition, the solid golf ball is better in durability. On the contrary, the solid golf ball generally has a higher hardness, thus receiving a large impact at shooting. Furthermore, the solid golf ball makes it difficult for the player to impart intentional spin and therefore it has a poor controllability especially at an approach shot. Because of these reasons, the solid golf ball has not been positively used by skilled golfers such as professional golfers and senior amateur golfers to whom excellent shot feeling and controllability is beneficial.

To improve the shot feeling and controllability of a solid ball, a variety of improvements have been made by adjusting the hardness of a cover, the hardness of a core and/or the hardness distribution thereof. For example, Japanese Unexamined Patent Publication No.9-239067 discloses a two-piece solid golf ball which includes a solid core having a specified hardness distribution for a surface, a center and a point at 5 mm inside from the surface; a cover having a specified hardness and thickness; and a specified number of dimples.

However, the shot feeling and controllability of a solid golf ball have not been improved without decreasing a flying distance and durability of the ball. Therefore, further improvements has been demanded to solve the problem.

SUMMARY OF THE INVENTION

An object of the present invention is to provide a solid golf ball which has an improved shot feeling and controllability without decreasing a flying distance and durability.

According to an aspect of the present invention, a solid golf ball includes a core and a cover. The core has a hardness of 55 to 75 at a center thereof and a hardness on a surface thereof that is greater than the hardness at the center by 10 or more. The cover has a hardness satisfying the following expressions (1) and (2):

$$(\text{hardness of the cover})-(\text{hardness at the center of the core})\leqq 17 \quad (1),$$

$$(\text{hardness of the cover})-(\text{hardness on the surface of the core})\leqq 5 \quad (2).$$

The hardness is defined in terms of JIS-C scale hardness meter.

According to another aspect of the present invention, a solid golf ball includes a core having a hardness of 55 to 75 at a center thereof and a hardness of 80 to 90 on a surface thereof, and a cover having a hardness of 80 to 90. The hardness of the cover satisfies the following expressions (1) and (2):

$$0\leqq(\text{hardness of the cover})-(\text{hardness at the center of the core})\leqq 17 \quad (1),$$

$$-10\leqq(\text{hardness of the cover})-(\text{hardness on the surface of the core})\leqq 5 \quad (2)$$

The hardness is defined in terms of JIS-C scale hardness meter.

DETAILED DESCRIPTION OF THE PREFERRED EMBODIMENTS OF THE INVENTION

Figure 1:
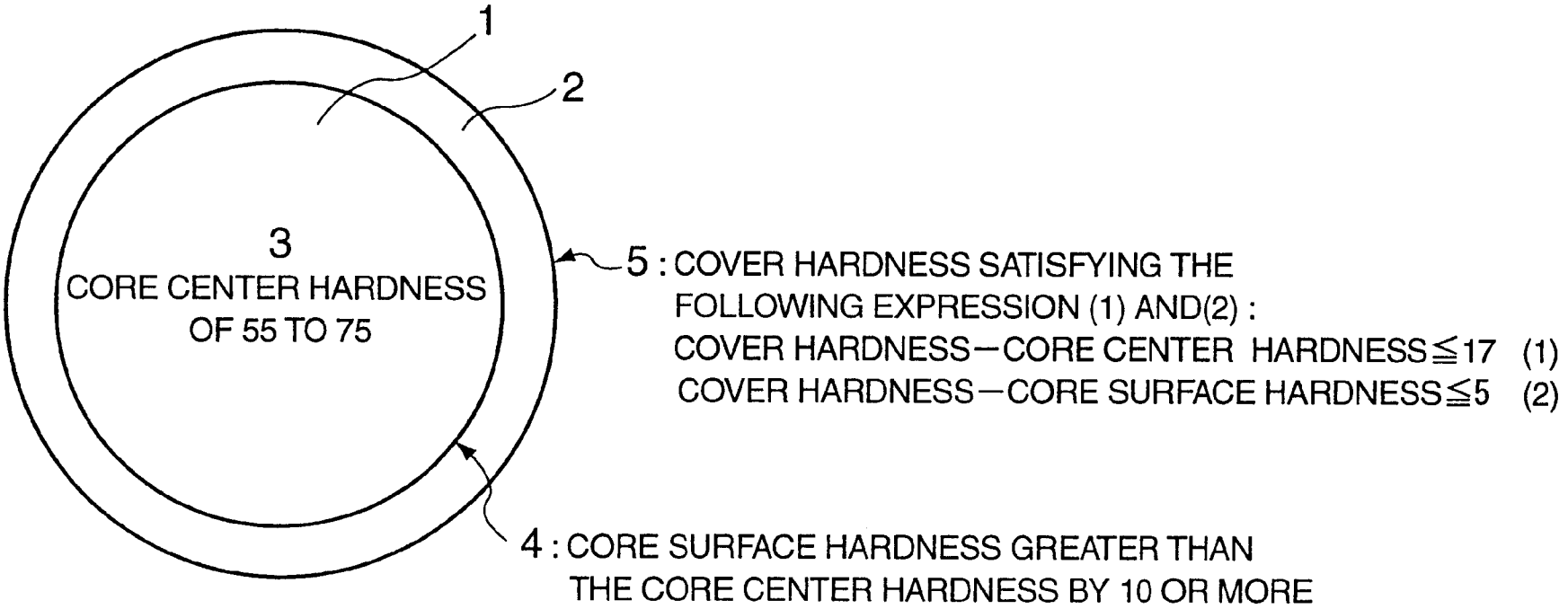
FIG. 1 is a sectional view illustrating a golf ball according to the present invention. The golf ball includes a core 1 and a cover 2 enclosing the core 1. A hardness at a core center 3, a hardness on a core surface 4 and a hardness of a cover surface 5 satisfy specific relationships.

In the present invention, the JIS-C hardness means a hardness measured by a C-type spring hardness meter in accordance with JIS-K6301 (a test for physical properties of vulcanized rubber).

The inventors have made a variety of attempts to improve the shot feeling and controllability of a solid golf ball to the same level as or better than those of a thread-wound golf ball, while maintaining a long flying distance and durability inherent to the solid golf ball. As a result, the inventors finally found that a solid golf ball satisfying all of the above properties can be obtained by adjusting the hardness of a core and a cover of the golf ball as follows: 1) the hardness at a center of the core is within a specified range, 2) the hardness at a surface of the core is greater than the center hardness of the core by a specific value or more, and 3) the cover hardness and the center hardness, and the cover hardness and the surface hardness have predetermined relationships, respectively.

One of the main features of the present invention is that a core of a solid golf ball has a center hardness of 55 to 75 in terms of a JIS-C scale hardness meter. The above range of hardness is desired in view of shot feeling and flying distance. The core center having a larger hardness than 75 is likely to decrease the shot feeling because of the following reason. A large impact due to, e.g., a driver shot, is likely to act to deform even the center of the core. However, since the core center is too hard to be deformed, the large impact power cannot be absorbed by the inside portion of the ball, and thereby it returns to a golfer as a reaction force. Thus, the shot feeling becomes bad. On the other hand, the core center having a less hardness than 55 also decreases the shot feeling, although he receives less impact. This is because the center core has a less resilience due to a large deformation of it, and therefore, at a shot, a golfer expects a poor flying distance. In addition, the small resilience of such a soft core center decreases the flying distance. The flying distance varies as the resilience of the core center varies besides the hardness of the cover and of the core surface. Specifically, the flying distance decreases as the resilience of the core center decreases. The lower limit of the range of the center core hardness is preferably 65, more preferably 68. The upper limit of the range is preferably 72.

Another main feature of the present invention is a core having a surface hardness larger than a center hardness by 10 or more. The hardness distribution of the core can adjust the deformation along a radius of the core caused by a shot so as to keep the launch angle of the ball in a desired range, to improve the flying distance. It can also improve the shot feeling. On the other hand, in the case of the core in which surface hardness is not larger than center hardness by 10 or more, i.e., the hardness distribution of the core is flat, only the surface portion of the core is likely to be deformed largely by a shot. This may give a low launch angle to the ball to decrease the flying distance, and a large impact against a golfer to decrease the shot feeling. A preferable lower limit of the difference between the surface hardness and the center hardness of the core is 11.

On the other hand, a preferable upper limit of the difference between the surface hardness and the center hardness of the core is 30, more preferably 20, further preferably 15. The difference larger than 30 is likely to transfer a deformation by a shot to the center of the core. Therefore, a golfer feels as if he hit a coreless ball. In other words, the shot feeling is not satisfactory. In addition, when the core has such a large hardness difference, most part of the energy provided to the ball at a shot is likely to be used for deformation of the ball, rather than kept in the ball for resilience. As a result, an energy loss generated inside the ball may increase and only a small portion of the energy can be used as resilience to fly the ball farther.

Although the surface hardness of the core can be adjusted as far as it satisfies the above relationship with the cover hardness, it is preferably 75 or more, more preferably 80 or more, further preferably 83 or more. Also, the surface hardness of the core is preferably 90 or less, more preferably 87 or less. When the surface hardness of the core is less than 75, the resilience of the core is likely to drop down, resulting in a decrease in the flying distance. On the other hand, when the surface hardness of the core is more than 90, although the core has a satisfactory resilience, the impact by a shot against a golfer is likely to become excessively large, resulting in a poor shot feeling.

As described above, a core of a solid golf ball according to the present invention can be made to have a desired center hardness and a desired surface hardness as far as they satisfy the above two main features. Preferably, the core has a hardness distribution having a center hardness of 65 to 75 and a surface hardness of 80 to 90, more preferably having a center hardness of 68 to 72 and a surface hardness of 83 to 87.

The core used in the present invention is formed from a core composition including a base rubber, a co-crosslinking agent and a crosslinking initiator. The core can have the above preferable hardness distribution by selecting materials for the base rubber, co-crosslinking agent and crosslinking initiator; adjusting the respective contents thereof; and adjusting vulcanizing conditions of the core composition such as vulcanizing temperature and time.

As the base rubber for the core, natural rubbers and synthetic rubbers, which have been known as the base rubber, may be used. Preferable base rubber is cis-1,4-polybutadiene rubber having 40% or more, more preferably 80% or more, of cis-bond. To the base rubber, other rubbers such as polyisoprene rubber, styrene butadiene rubber and ethylene-propylene-diene terpolymer (EPDM) may be admixed, without impairing the advantageous effect of the present invention.

Examples of the co-crosslinking agent may include metal salts of unsaturated carboxylic acid, but not limited thereto. preferably, mono- or di-valent metal salts having 3 to 8 carbon atoms per a molecular such as zinc acrylate and zinc methacrylate may be used. More preferably, a zinc acrylate may be used, since it can provide a high resilience to the obtained core. The content of co-crosslinking agent is preferably 20 to 35 parts by weight, more preferably 25 to 32 parts by weight, per 100 parts by weight of base rubber. In the case that the content is less than 20 parts by weight, the obtained core has an unsatisfactory low hardness due to a low crosslinking density in the core. Thus, the resilience of the golf ball at a shot is likely to decrease, resulting in a poor shot feeling. In addition, the core having such a low hardness is likely to decrease the durability of the golf ball. On the other hand, in the case that the content of co-crosslinking agent is more than 35 parts by weight, the obtained core is likely to have an excessively high hardness due to a high crosslinking density in the core. Thus, the impact by a shot against a golfer may increase, resulting in a poor shot feeling.

Examples of the crosslinking initiator may include organic peroxide such as dicumyl peroxide and di-t-butyl peroxide. Preferably, dicumyl peroxide may be used. The content of organic peroxide is preferably 0.5 to 5, more preferably 1 to 3 parts by weight, per 100 parts by weight of the base rubber, but not limited thereto. In the case that the content of organic peroxide is less than 0.5 parts by weight, the obtained core has an unsatisfactory low hardness due to a low crosslinking density in the core. This may cause a poor shot feeling and a decreased durability. On the other hand, in the case that the content of organic peroxide is more than 5 parts by weight, the obtained core is likely to have an excessively high hardness due to a high crosslinking density in the layer. Thus, the impact by a shot against a golfer may increase, resulting in a poor shot feeling.

In addition to the base rubber, crosslinking agent and co-crosslinking agent, if necessary, the rubber composition for the core can include a filler such as zinc oxide, barium sulfate, silica, calcium carbonate and zinc carbonate. These can be used solely or in a combination of two or more kinds. The total content of the filler is preferably 3 to 40 parts by weight, more preferably 5 to 30 parts by weight, per 100 Parts by weight of the base rubber. If necessary, the rubber composition may further include other sulfur additives such as thios and sulfides, antioxidant such as phenol, metal powder having a high specific gravity, such as tungsten and molybdenum powder.

To produce a core from the rubber composition, the rubber composition is mixed in a Banbury mixer, a roll kneader or the like. Then the mixed composition is compressed and vulcanized in a mold. The vulcanizing conditions such as vulcanizing temperature and time may be varied in accordance with the rubber composition and a desired hardness distribution of the core. A preferable vulcanizing temperature is 40 to 180° C. and a preferable vulcanizing time is 10 to 60 minutes.

In addition to the above two main features regarding a core, the hardness of a cover of a golf ball according to the present invention satisfies the following expressions (1) and (2):

$$(\text{cover hardness})-(\text{center hardness of core})\leqq 17 \quad (1)$$

$$(\text{cover hardness})-(\text{surface hardness of core})\leqq 5 \quad (2)$$

When the expression (1) is not satisfied, i.e., a cover hardness is more than (center hardness of core+17), the cover hardness is excessively larger than the center hardness of the core and it causes problems such as a poor shot feeling and a decreased controllability due to a low spin rate of the golf ball. In addition, a good shot feeling and resilience cannot be always provided at a shot by every kind of golf clubs such as an wood-type club and an iron club. For example, the golf ball having such a large cover hardness can realize an excellent shot feeling at a shot by a wood-type golf ball, while the golf ball is likely to provide too heavy shot feeling against the golfer (i.e., the golfer cannot feel the resilience of the ball) or to provide a poor resilience at a shot by an iron club.

For the above-described reasons, a preferable difference between the cover hardness and the center hardness of the core is 17 or less, more preferably 16 or less and further preferably 15 or less.

On the other hand, even in the case that the expression (1) is satisfied, if the cover hardness is excessively small, the center hardness of the core may need to be smaller than the above-described specific range (i.e., 55 to 75), resulting in a decreased resilience of the golf ball.

A preferable lower limit of (cover hardness–center hardness of the core) is preferably 0 or more. When the difference is less than 0, i.e., the center hardness of the core is more than the cover hardness, the deformation by a shot is likely to concentrate to the cover of the golf ball, even if the core has a hardness within the above specific range. As a result, the core has a small deformation, which causes a hard shot feeling. It also causes to decrease flight performance due to the small launch angle of the golf ball. The lower limit of the difference is more preferably 10 or more, further preferably 11 or more. The difference satisfying the above lower limit is preferred to provide a predetermined amount of deformation to the golf ball by a shot so as to obtain a satisfactory flight performance and shot feeling.

In the case that the expression (2) is not satisfied, i.e., the golf ball has a cover hardness more than (the surface hardness of a core+5), if the surface hardness of the core is within the above-described specific range, the cover hardness is too large to provide the golf ball with a poor spin rate, resulting in a decreased controllability. Thus, a preferable upper limit of the difference of (cover hardness–surface hardness of core) is 4 or less, further preferable 3 or less.

On the other hand, a preferable lower limit of the difference is −10 or more, more preferably −5 or more, further preferably −3 or more, the most preferably 0 or more. In the case that the surface hardness of the core is too much larger than the hardness of the cover, there may be problems such as a decreased resilience due to an excessively small hardness of the cover and a poor shot feeling due to an excessively large surface hardness of the core. Also, it may be difficult to improve all properties of the shot feeling, controllability and resilience of the golf ball, since an amount of deformation of the golf ball by a shot cannot be adjusted within a desired range due to the large difference between the cover hardness and the surface hardness of the core.

In view of the above, specifically, preferable JIS-C hardness of the cover may be 75 to 92. When the cover hardness is less than 75, the resilience of the golf ball is likely to drop down, resulting in a decreased flying distance. In addition, the golf ball is likely to provide a poor shot feeling to a golfer, since the golfer can feel small resilience at a shot. On the other hand, when the hardness of the cover is more than 92, although the golf ball has a satisfactory resilience, it is likely to have a poor controllability. This is because the ball has a low spin rate due to its large hardness. Also, the large hardness may cause a hard shot feeling.

The golf ball according to the present invention includes any golf ball having the hardness distribution which satisfies the above described the hardness of the cover and the hardness of the core. By preventing the cover from having too large hardness and by providing the specific hardness distribution in which the hardness decreases from the cover to the center of the core so as to satisfy the predetermined difference of the hardness, it is possible to optimize an amount of deformation of the golf ball due to a shot by a driver to minimize the energy loss. As a result, the resilience of the golf ball can increase to improve a flying distance. Also, the impact by a shot can decrease to improve shot feeling. Furthermore, the spin rate of the golf ball due to a shot by an iron club can increase to improve a controllability.

Of the above golf balls according to the present invention, a preferable golf ball has a center hardness of the core of 65 to 75, a surface hardness of the core of 80 to 90, and a hardness of the cover of 80 to 90. more preferably, the golf ball has a center hardness of a core of 68 to 72, a surface hardness of the core of 83 to 87, and a hardness of the cover of 83 to 88.

The cover of the golf ball used in the present invention may be made from a cover composition including a thermoplastic resin as a base resin. If necessary, the cover composition may further include additives such as coloring agent, dispersant, antioxidant, ultraviolet absorbent and light stabilizer.

Examples of the thermoplastic resin contained in the base resin for the cover composition may include ionomer resins; thermoplastic elastmers such as polyurethane-based, polyamide-based and polyester-based elastomer; epoxidized diene block copolymer; and thermoplastic elastomer having a hydroxyl group at the terminal thereof. These can be used solely or in a combination of two or more kinds. Preferably used may be the base resin having thermoplastic polyamide elastomer (hereinafter, referred to as "Component A"), ethylene-unsaturated carboxylic acid copolymer type ionomer and/or ethylene-unsaturated carboxylic acid-unsaturated carboxylate terpolymer type ionomer (hereinafter, referred to as "Component B"), and epoxidized diene block copolymer (hereinafter, referred to as "Component C"). "Component B" is an "ionomer", which means a copolymer or terpolymer with a portion of the carboxylic groups neutralized by a metal ion. The term "ethylene-unsaturated carboxylic acid copolymer" represents a copolymer containing two monomer types, or ethylene and unsaturated carboxylic acid. The term "ethylene-unsaturated carboxylic acid-unsaturated carboxylate terpolymer" represents a terpolymer containing three monomer types, or ethylene, unsaturated carboxylic acid and unsaturated carboxylic ester.

The respective amount by weight of the above components contained in the base resin for the cover composition is as follows: (i) the ratio by weight of Component A to Component B is 1:99 to 70:30; and (ii) the amount of Component C is 1 to 40 parts by weight per 100 parts by weight of the total weight of Components A and B.

Generally, thermoplastic elastomer has a polymer block in which the movement of the molecules is restricted by hydrogen bonding (i.e. hard segment), and a polymer block in which the movement of the molecules is not restricted (i.e. soft segment). Component A or an thermoplastic polyamide elastomer has polyamide as a hard segment. Such an elastomer has a high flexural modulus with a relatively low hardness. Therefore, mixing the elastomer (i.e., Component A) with the ionomer (i.e., Component B) can solve the problem inherent to the ionomer that the ionomer has a rapidly decreased resilience by softening. That is, the cover made of the blend of Components A and B can be soften (i.e., lowered its hardness) with maintaining a higher flexural modulus than that of Component B itself, i.e., mixed with no Component A, which is soften to the same extent (e.g., by increasing the content of the terpolymer type ionomer, what is called, a soft ionomer). In other words, the cover can be soften without decreasing resilience of the cover. As a result, a golf ball having such a cover can have an excellent controllability since intentional spin can be easily imparted thereon, while maintaining a long distance which is a feature inherent to a solid golf ball. One of specific examples of Component A may be "Pebax® 2533" sold by TORAY. Co. Ltd.

A Preferable elastomer as Component A have a Shore D hardness of 20 to 50, more preferably 25 to 45. In addition, the elastomer preferably has a flexural modulus of 10 to 150 MPa, more preferably 20 to 130 MPa. When the elastomer has a Shore D hardness less than 20, the obtained cover is likely to be too soft to attain the above preferable hardness of the cover. When the elastomer has a Shore D hardness more than 50, the obtained cover is likely to be too hard to attain the above preferable hardness of the cover. On the other hand, when the elastomer has a flexural modulus less than 10 MPa (i.e., relatively soft elastomer), the obtained cover is likely to be too soft, thereby decreasing resilience of the cover. When the elastomer has a flexural modulus more than 150 MPa (i.e., relatively hard elastomer), the obtained cover is unlikely to be soften to a desired extent, and therefore the shot feeling may not be improved.

Component B of ethylene-unsaturated carboxylic acid copolymer type ionomer and/or ethylene-unsaturated carboxylic acid-unsaturated carboxylate terpolymer type ionomer have a high flexural modulus. Thus, it may be effective for improving resilience of the obtained cover. In order to use the effectiveness sufficiently, the flexural modulus of the ionomer is preferably 200 MPa or more.

Examples of the α,β-unsaturated carboxylic acid contained the above ionomer may include acrylic acid, methacrylic acid, fumaric acid, maleic acid, crotonic acid and the like. Preferably, acrylic acid, methacrylic acid may be used. Examples of α,β-unsaturated carboxylate contained in the above ionomer may include methyl, propyl, n-butyl and isobutyl ester of acrylic acid, methacrylic acid, fumaric acid,maleic acid and the like. Preferably,acrylate and methacrylate may be used. Examples of the matal ion, which neutralizes a portion of the carboxyl groups of the copolymer containing two monomer types (ethylene and α,β-unsaturated carboxylic acid) or of the terpolymer containing three monomer types (ethylene, α,β-unsaturated carboxylic acid and α,β-unsaturated carboxylate), may include sodium ion, lithium ion, zinc ion calcium ion, magnesium ion, potassium ion and the like.

Specific examples of ethylene-unsaturated carboxylic acid copolymer type ionomer include: ionomers sold by Mitui DuPont Chemical Co.,Ltd. such as Himilan® 1555 (sodium ion-neutralized copolymer), Himilan® 1557 (zinc ion-neutralized copolymer), Himilan® 1601 (sodium ion-neutralized copolymer), Himilan® 1605 (sodium ion-neutralized copolymer), Himilan® 1706 (zinc ion-neutralized copolymer), Himilan® 1707 ( sodium ion-neutralized copolymer), Himilan® AM7315 (zinc ion-neutralized copolymer), Himilan® AM7317 (zinc ion-neutralized copolymer), Himilan® AM7311 (magnesium ion-neutralized copolymer) and Himilan® AK7320 (potassium ion-neutralized copolymer); and ionomers sold by DuPont Co., Ltd. such as Surlyn® 8511 (zinc ion-neutralized copolymer), Surlyn® 8945 (sodium ion-neutralized copolymer), Surlyn® 8920 (sodium ion-neutralized copolymer), Surlyn® 8940 (sodium ion-neutralized copolymer), Surlyn 9910 (zinc ion-neutralized copolymer), Surlyn® 9945 (zinc ion-neutralized copolymer), Surlyn® AD7930 (lithium ion-neutralized copolymer) and Surlyn® AD7940 (lithium ion-neutralized copolymer).

Specific examples of the ethylene-unsaturated carboxylic acid-unsaturated carboxylate terpolymer type ionomer include: ionomers sold by Mitui DuPont Chemical Co., Ltd. such as Himilan® 1856 (sodium ion-neutralized terpolymer), Himilane 1855 (zinc ion-neutralized terpolymer) and Himilan® AM7316 (zinc ion-neutralized terpolymer); and ionomers sold by DuPont Co., Ltd. such as Surlyn® AD8265 (sodium ion-neutralized terpolymer), Surlyn® AD8269 (sodium ion-neutralized terpolymer) and Surlyn® AD8542 (magnesium ion-neutralized terpolymer).

Component C of epoxidized dien block copolymer is made by epoxidation of the double bond in conjugated dien compound of block copolymer or partly hydrogenerated block copolymer. The block copolymer is made from at least one of polymer block having vinyl aromatic compound as a main component and at least one of polymer having conjugated dien compound as a main component. The partly hydrogenerated block copolymer is obtained from the block copolymer by hydrogenation.

As the vinyl aromatic compound of the block copolymer, styrene, α-methyl styrene, vinyl toluene, p-t-butyl styrene, 1,1-diphenil ethylene and the like may be used solely or in combination of two or more thereof. Preferable, styrene may be used. As conjugated dien compound of the copolymer block, butadiene, isoprene, 1,3-pentadiene, 2,3-dimethyl-1, 3-butadiene and the like may be used solely or in combination of two or more thereof. Preferably, butadiene, isoprene, or the combination thereof may be used.

As the Component C, preferred is a block copolymer which comprises of polystyrene block (referred to as "S") and polybutadiene block having a epoxy group (referred to as "B") and they are linked in the form S-B-S. A specific example of the block copolymer may be "Epofriend" sold by Daicel Chemical Industries Co., Ltd.

Preferably, the respective amount of the above Components A, B and C contained in the base resin for the cover composition may be as follows: (i) the ratio of Component A to Component B is 1:99 to 70:30, more preferably 5:95 to 35:65; and (ii) the amount of Component C is 1 to 40 parts by weight, more preferably 1 to 20 parts by weight, per 100 parts by weight of the total weight of Components A and B. When the amount of Component A is less than the above preferable range, the obtained cover is likely to be too hard. When the amount of Component A is more than the above preferable range, the obtained cover is likely to be too soft, thereby decreasing resilience of the golf ball. In addition, when the amount of Component B is less than the above preferable range, the obtained cover is likely to have an excessively low flexural modulus, thereby decreasing the resilience of the golf ball. When the amount of Component B is more than the above preferable range, the obtained cover is likely to be too hard to have a sufficient flexibility. Furthermore, when the amount of Component C is less than the above preferable range, compatibility between Components A and B is likely to decrease. Therefore, formability of the cover may be impaired, resulting in a poor appearance of the golf ball. When the amount of Component C is more than the above preferable range, the obtained cover is likely to be too soft to provide a sufficient resilience to the golf ball.

The base resin may further include any other resins in addition to the above Components A, B and C. The preferable amount of the additional resin may be less than 10 wt% to the total weight of the base resin contained in the cover composition.

Preferably, the respective amount of the base resin components contained in the cover composition is adjusted in such a manner that the flexural modulus of the obtained cover is within the following range: the lower limit is 70 MPa or more, more preferable 100 MPa or more; and the upper limit is 220 MPa or less, more preferable 210 MPa or less. When the cover has a flexural modulus less than 70 MPa, the resulting golf ball is likely to be poor in resilience, even in the case that it satisfies the features of the hardness and/or hardness distribution according to the present invention. When the cover has a flexural modulus more than 220 MPa, the resulting golf ball is likely to have a poor shot feeling due to the small flexibility of the cover.

The cover composition may further contain other additives, if necessary. Examples of the additives include a colorant, a dispersant, an antioxidant, a UV absorber and a light stabilizer. The cover composition is prepared by mixing the above resin components and desired additives with heat at 150 to 250° C. for 0.5 to 15 minutes in an internal mixer such as a Banbury mixer and a kneader.

Preferably, a golf ball according to the present invention may be a two-piece golf ball in which a cover directly encloses a core. However, a golf ball may have a further layer intervening between a core and a cover.

The process for forming the cover onto the core may include any known method such as injection molding and compression molding. For example, in the compression molding, two preformed half-shells are prepared, and the core is put in to one of the half-spherical shells, followed by covering the core with the other half-spherical shell in such a manner that the two shells encloses the core in the shape of a sphere. Alternatively, in the injection molding, the cover composition is injected on the core to form a cover.

The cover preferably has a thickness of 1.0 to 1.8 mm, more preferably 1.3 to 1.6 mm. In case of the thickness less than 1.0 mm, a deformation of the cover by a shot is likely to be smaller, resulting in an excessively small contact area with a golf club. This causes a low spin rate of the golf ball imparted by a shot of a short iron, thereby decreasing the controllability. In addition, such a thin cover of the golf ball is difficult to formed in the manufacturing process, and it may cause a poor productivity. Furthermore, the thin cover is likely to be poor in strength. On the other hand, in case of the thickness of the cover more than 1.8 mm, the resilience of the cover is likely to be impaired especially when a hardness of the cover is small, resulting in a decreased flying distance.

In forming a cover on the core, dimples may be impressed onto the surface of the cover as needed. The number of dimples may be 360 to450, preferably 370 to 420 per a golf ball. After cover forming, paint finishing and mark stamping may be provided on the surface for serving commercial sale.

As described above, according to the present invention, a solid golf ball having an improved controllability and shot feeling without decreasing a flying distance and durability inherent to a solid golf ball can be provided by adjusting the center hardness of the core within a specific range and also optimizing the hardness distribution from the cover surface to the core center of the golf ball.

EXAMPLE

[Methods of Measurement and Evaluation]

① Hardness (degree)

In the present invention, the JIS-C hardness was measured by a C-type spring hardness meter in accordance with JIS-K6301.

The surface hardness of the core of a golf ball was measured by pressing on the surface of the core by a stylus.

The center hardness of the core was measured by cutting the core along the center line and pressing on the center of the cut surface by a stylus.

The hardness of the cover of a golf ball was measured by pressing on the surface of the cover (i.e., the surface of the golf ball) by a stylus, with the cover enclosing the core.

② Flight Performance

The golf ball was hit by a driver, and the launch angle, spin rate, flying distance (carry) were measured as follows.

A W#1 driver having a metal head was mounted to a swing robot manufactured by True Temper Co., Ltd. and the golf ball was hit by the driver at a head speed of 49 m/sec. The angle immediately after the golf ball was hit, i.e., launch angle (a height of the flight curve) was measured by a sensor set on a predetermined position. At the same time, the amount of back spin immediately after the golf ball was hit (i.e., spin rate) was measured by taking a photographic strip. Also, the flying distance, which is the distance from the point where the ball was hit to the point where the ball fell to the ground (i.e. carry), was measured.

To evaluate the controllability by an iron shot, a spin rate were measured in the same manner as those by a driver shot as described above with the exception that an iron (Sand Wedge) was used instead of a driver and the ball was hit at an initial speed of 20 m/sec.

③ Shot Feeling

Each of ten professional golfers hit a golf ball using a W#1 driver having a metal head, and evaluate the shot feeling of the ball based on the number of golfers who answered the shot feeling was "GOOD", under the following criteria. The shot feeling meant the total feeling including the impact and resilience which the golfer received at a shot.

○: 8 to 10 golfers answered "GOOD";

Δ: 4 to 7 golfers answered "GOOD"; and

X: 0 to 3 golfers answered "GOOD".

[Production of Core]

Core "A" to "E" were produced as shown in Table 1. More specifically, Core "A" was produced as follows. A composition for Core "A" was prepared by mixing 100 parts by weight of cis-1,4-polybutadiene rubber ("BR18" manufactured by JSR Co., Ltd), 34 parts by weight of zinc acrylate, 5.8 parts by weight of zinc oxide, 0.5 part by weight of antioxidant ("Yoshinox425" manufactured by Yoshitomi Seiyaku Sha), 1.5 parts by weight of dicumyl peroxide, 0.3 part by weight of diphenyl disulfide and 9.3 parts by weight of Tungsten. The composition was compressed and vulcanized at 155° C. for 15 minutes and then at 165° C. for 8 minutes to form a core having a diameter of 39.6 mm. The obtained core had a center hardness of 72 and a surface hardness of 87.

Core "B" "E" were produced in the same manner as Core "A" with the exception that the specific composition and vulcanizing conditions given in Table 1 were applied.

TABLE 1

| | Core | | | | |
|---|---|---|---|---|---|
| | A | B | C | D | E |
| Cis-1,4-polybutadiene | 100 | 100 | 100 | 100 | 100 |
| Zinc acrylate | 34 | 34 | 34 | 34 | 34 |
| Zinc oxide | 5.8 | 5.8 | 5.8 | 5.8 | 5.8 |
| Antioxidant | 0.5 | 0.5 | 0.5 | 0.5 | 0.5 |
| Dicumyl peroxide | 1.5 | 1.2 | 1.2 | 0.9 | 0.9 |
| Diophenyl disulfide | 0.3 | 0.3 | 0.3 | 0.3 | 0.3 |
| Tangsten | 9.3 | 9.3 | 9.3 | 9.3 | 9.3 |
| Vulcanization | 155 × 15 | 150 × 20 | 155 × 17 | 145 × 25 | 150 × 20 |
| Temp(° C.) × Time(min) | 165 × 8 | 165 × 8 | 165 × 8 | 165 × 8 | 165 × 8 |
| Core diameter | 39.6 | 39.6 | 39.6 | 39.6 | 39.6 |
| Center hardness | 72 | 72 | 68 | 78 | 73 |
| Surface hardness | 87 | 83 | 83 | 78 | 78 |

[Production of Golf Ball]

A cover composition "a" to "d" were respectively prepared as shown in Table 2.

Each prepared cover composition is injected on the core to produce a golf ball.

TABLE 2

| | Cover Composition | | | |
|---|---|---|---|---|
| | a | b | c | d |
| Ionomer | | | | |
| 1 | 20 | — | — | — |
| 2 | 20 | — | — | — |
| 3 | 40 | 20 | — | 30 |
| 4 | — | 30 | — | 10 |
| 5 | — | — | 30 | — |
| 6 | — | 30 | — | — |
| 7 | — | — | 20 | — |
| 8 | — | — | 50 | 55 |
| 9 | — | — | — | 5 |
| Elastomer resin | 10 | 12 | — | — |
| Block copolymer | 8 | 8 | — | — |
| Titanium oxide | 2 | 2 | 2 | 2 |
| JIS-C Hardness (degree) | 83 | 87 | 95 | 87 |

In Table 2, ionomers "1" to "9", elastomer resin and block copolymer respectively represent the following products.

Ionomer 1: "Surlyn® 9945", an ionomer resin of a zinc ion neutralized ethylene-methacrylic acid copolymer (sold by DuPont Co., Ltd.);

Ionomer 2: "Surlyn® 8945", an ionomer resin of a sodium ion-neutralized ethylene-methacrylic acid copolymer (sold by DuPont Co., Ltd.);

Ionomer 3: "Surlyn® AD8542", an ionomer resin of a magnesium ion-neutralized ethylene-methacrylic acid-isobutyl acrylate terpolymer (sold by DuPont Co., Ltd.);

Ionomer 4: "Himilan® 1555", an ionomer resin of sodium ion-neutralized ethylene-methacrylic acid copolymer (sold by Mitsui DuPont Chemical Co., Ltd.);

Ionomer 5: "Himilan® 1557", an ionomer resin of a zinc ion-neutralized ethylene-methacrylic acid copolymer (sold by Mitsui DuPont Chemical Co., Ltd.);

Ionomer 6: "Himilan® 1706", an ionomer resin of a zinc ion-neutralized ethylene-methacrylic acid copolymer (sold by Mitsui DuPont Chemical Co., Ltd.);

Ionomer 7: "Himilan® 1707", an ionomer resin of a sodium ion-neutralized ethylene-methacrylic acid copolymer (sold by Mitui DuPont Chemical Co., Ltd.);

Ionomer 8: "Himilan® 1855", an ionomer resin of a zinc ion-neutralized ethylene-methacrylic acid-isobutyl acrylate terpolymer (sold by Mitsui DuPont Chemical Co., Ltd.);

Ionomer 9: "Himilan® 1605", an ionomer resin of a sodiumion-neutralized ethylene-methacrylic acid copolymer (sold by Mitsui DuPont Chemical Co., Ltd.);

Elastomer resin: "Pebax® 2533", a thermoplastic polyamide elastomer (sold by TORAY. Co. Ltd.); and Epoxidized diene block copolymer: "Epofriend®, A1010", a styrene elastomer which has polystyrene blocks (referred to as "S") and polybutadiene. block (referred to as "B") and they are linked in the form of S-B-S and epoxidized (sold by Daicel Chemical Industries Co., Ltd.).

Examples and Comparative Examples

Golf balls in Examples 1 to 5 and Comparative Examples 1 to 3 were produced as shown in Table 3. Specifically, a golf ball in Example 1 was produced by injecting the cover composition "b" onto the surface of core "A" to form a cover enclosing core "A", followed by painting the surface of the cover. The obtained solid golf ball has an outside diameter of 42.7 mm and a total weight of 45.4 gram.

Then, the above described evaluations were made to the obtained golf balls. The results were shown in Table 3.

Golf balls in Examples 2 to 5 and Comparative Examples 1 to 3 were produced and evaluated in the same manner as the one in Example 1 with the exception that the cover composition shown in Table 3 were used. The results were shown in Table 3.

TABLE 3

| | Ex 1 | Ex 2 | Ex 3 | Ex 4 | Ex 5 | ComEx 1 | ComEx 2 | ComEx 3 |
|---|---|---|---|---|---|---|---|---|
| Core | A | B | C | B | A | D | E | B |
| Cover composition | b | b | a | a | d | a | a | c |
| Hardness: | | | | | | | | |
| Center of Core | 72 | 72 | 68 | 72 | 72 | 78 | 73 | 72 |
| Surface of Core - Center of Core | 15 | 11 | 15 | 11 | 15 | 0 | 5 | 11 |
| Cover - Surface of Core | 0 | 4 | 0 | 0 | 0 | 5 | 5 | 12 |
| Cover - Center of Core | 15 | 15 | 15 | 11 | 15 | 5 | 10 | 23 |
| Thickness of Cover (mm) | 1.6 | 1.6 | 1.6 | 1.6 | 1.6 | 1.6 | 1.6 | 1.6 |
| Total weight of golf ball | 45.41 | 45.39 | 45.37 | 45.42 | 45.38 | 45.42 | 45.38 | 45.37 |
| Properties | | | | | | | | |
| Shot by W#1: Launch angle(°) | 10.2 | 10.2 | 10.1 | 10.1 | 10.2 | 10.0 | 10.1 | 10.3 |
| Spin rate(rpm) | 2470 | 2500 | 2600 | 2630 | 2540 | 2680 | 2670 | 2450 |
| Carry(m) | 226.6 | 227.2 | 226.1 | 226.8 | 225.5 | 224.8 | 225.2 | 227.0 |
| Shot by SW: Spin rate(rpm) | 6800 | 6780 | 6880 | 6860 | 6730 | 6720 | 6680 | 5800 |
| Evaluations: | | | | | | | | |
| Flight performance by W#1 | ◎ | ◎ | ◎ | ◎ | ○ | x | Δ | ◎ |
| Controllability by SW | ○ | ○ | ◎ | ◎ | ○ | Δ | Δ | x |
| Shot feeling | ◎ | ◎ | ◎ | ◎ | ○ | x | x | x |

The golf ball in Comparative Example 1, in which the difference between the center and surface hardness of the core was zero, had a higher spin rate by a driver shot and a shorter flying distance of 224.8 m than the ones in other Examples and Comparative Examples. In addition, the golf ball had a poor shot feeling, although it has a surface hardness of the core lower than the ones of core "A", "B" and "C" used in Examples 1 to 5.

The golf ball in Comparative Example 2, in which the difference between the center and surface hardness of the core was 5, also gave worse results in a spin rate by a driver shot, a flying distance and shot feeling than the golf balls in Examples, however the results were not so poor as the results in Comparison Example 1.

The golf ball in Comparative Example 3 having the same core as the golf balls in Examples 2 and 4, in which the relationship between the core and cover hardness according to the present invention was not be satisfied, had an excessively large cover hardness. This impaired a spin rate by a sand wedge shot and also shot feeling at a driver shot.

On the other hand, the golf balls in Examples 1 to 5, in which the hardness according to the present invention (i.e., the center and surface hardness of the core and the relationship between the core and cover hardness) were satisfied, gave good results in a flying distance by a driver shot, a spin rate by a sand wedge shot, and shot feeling.

The golf ball in Example 5 having cover "d", which was made from a mixture including only ionomer resins (i.e., including no elastomer resin and no block copolymer), has a shorter flying distance, a lower spin rate by a sand wedge shot (i.e., a worse controllability), and worse shot feeling than the golf balls in the other Examples.

What is claimed is:

1. A solid golf ball with a defined hardness profile, hardness being defined in terms of JIS-C scale hardness meter, said golf ball comprising:

a core having a hardness of 55 to 75 at a center thereof and a hardness on a surface thereof that is greater than the hardness at the center by 10 to 30; and a cover made from a base resin comprising: a Component A consisting of a thermoplastic polyamide elastomer; a Component B consisting of an ethylene-unsaturated carboxylic acid copolymer type ionomer and/or an ethylene-unsaturated carboxylic acid-unsaturated carboxylate terpolymer type ionomer; and a Component C consisting of an epoxidized diene block copolymer, wherein the ratio by weight of Component A to Component B is 1:99 to 70:30 and the content of Component C is 1 to 40 parts by weight per 100 parts by weight of Components A and B, said cover having a hardness of 75 to 92 and satisfying the expressions $$0 \leqq (\text{hardness of the cover}) - (\text{hardness at the center of the core}) \leqq 17$$

and $$-10 \leqq (\text{hardness of the cover}) - (\text{hardness on the surface of the core}) \leqq 5.$$

2. The solid golf ball according to claim 1, wherein the cover has a thickness of 1 to 1.8 mm.

3. The solid golf ball according to claim 1, wherein the thermoplastic polyamide elastomer has a Shore D hardness of 20 to 50.

4. The solid golf ball according to claim 1, wherein the thermoplastic polyamide elastomer has a flexural modulus of 10 to 150 MPa.

5. The solid golf ball according to claim 1, wherein the base resin further comprises resins in addition to the Components A, B, and C, the content of the other resins being 10 wt % or less of the base resin, and wherein the base resin has a flexural modulus of 70 to 220 MPa.

6. A solid golf ball with a defined hardness profile, hardness being defined in terms of JIS-C scale hardness meter, said golf ball comprising:

a core having a hardness of 55 to 75 at a center thereof and a hardness of 80 to 90 on a surface thereof; and a cover made from a base resin comprising: a Component A consisting of a thermoplastic polyamide elastomer; a Component B consisting of an ethylene-unsaturated carboxylic acid copolymer type ionomer and/or an ethylene-unsaturated carboxylic acid-unsaturated carboxylate terpolymer type ionomer; and a Component C consisting of an epoxidized diene block copolymer, wherein the ratio by weight of Component A to Component B is 1:99 to 70:30 and the content of Component C is 1 to 40 parts by weight per 100 parts by weight of Components A and B, said cover having a hardness of 80 to 90, the hardness of the cover satisfying the expressions $$0 \leqq (\text{hardness of the cover}) - (\text{hardness at the center of the core}) \leqq 17$$

and $$-10 \leqq (\text{hardness of the cover}) - (\text{hardness on the surface of the core}) \leqq 5.$$

7. The solid golf ball according to claim 6, wherein the cover has a thickness of 1 to 1.8 mm.

* * * * *